US007371288B2

(12) United States Patent
Cho et al.

(10) Patent No.: US 7,371,288 B2
(45) Date of Patent: May 13, 2008

(54) DISHWASHER AND METHOD FOR CONTROLLING THE SAME

(75) Inventors: In Haeng Cho, Changwon-si (KR); Joung Hun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 569 days.

(21) Appl. No.: 10/868,834

(22) Filed: Jun. 17, 2004

(65) Prior Publication Data

US 2005/0000544 A1 Jan. 6, 2005

(30) Foreign Application Priority Data

Jul. 3, 2003 (KR) ..... 10-2003-0044920
Jul. 25, 2003 (KR) ..... 10-2003-0051508
Jul. 25, 2003 (KR) ..... 10-2003-0051509
Jul. 25, 2003 (KR) ..... 10-2003-0051510

(51) Int. Cl.
*B08B 3/02* (2006.01)

(52) U.S. Cl. ..... 134/18; 134/25.2; 134/56 D; 134/57 D; 134/58 D

(58) Field of Classification Search ..... 134/18, 134/25.2, 57 D, 56 D, 58 D
See application file for complete search history.

(56) References Cited

U.S. PATENT DOCUMENTS 5,291,626 A * 3/1994 Molnar et al. ..... 8/158
5,586,567 A * 12/1996 Smith et al. ..... 134/57 D
5,800,628 A * 9/1998 Erickson et al. ..... 134/18

* cited by examiner

*Primary Examiner*—Michael Barr
*Assistant Examiner*—Saeed Chaudhry
(74) *Attorney, Agent, or Firm*—McKenna Long & Aldridge LLP

(57) ABSTRACT

A dishwasher and a method for controlling the same, performing a main washing cycle depending upon an amount of food residue on used dishes or a pollution level thereof, are disclosed. The method includes supplying washing water to the dishwasher, detecting for an N number of times a pollution level of the supplied washing water during a preliminary washing cycle, and comparing the detected pollution levels with a reference pollution level, and carrying out a main washing cycle depending upon a comparison result between the detected pollution levels and the reference pollution level.

32 Claims, 5 Drawing Sheets

DISHWASHER AND METHOD FOR CONTROLLING THE SAME

CROSS-REFERENCE TO RELATED APPLICATIONS

This application claims the benefit of Korean Application Nos. P2003-044920, filed on Jul. 3, 2003, P2003-051508, filed on Jul. 25, 2003, P2003-051509, filed on Jul. 25, 2003, and P2003-051510, filed on Jul. 25, 2003, which are hereby incorporated by reference as if fully set forth herein.

BACKGROUND OF THE INVENTION

1. Field of the Invention

The present invention relates to a dishwasher, and more particularly, to a dishwasher and a method for controlling the same. Although the present invention is suitable for a wide scope of applications, it is particularly suitable for controlling a washing cycle in accordance with a pollution level of dishes to be washed, thereby enhancing washing efficiency of the dishwasher.

2. Discussion of the Related Art

A dishwasher is an appliance removing residues remaining on used dishes and thoroughly washing the dishes. As shown in FIG. 1, a dishwasher generally includes a water tank 8 holding water supplied from a faucet 7, and a washing water jet 9 spraying the water in the tank to dishes to be washed. The water held in the water tank 8 is supplied to the washing water jet 9 through a washing motor 3*a*, and the water sprayed by the washing water jet 9 is held back into the water tank 8. The dishwasher also includes a water supply valve 3*b* for controlling the amount of water supplied from the faucet 7, and a drainage valve (not shown) for draining the water within the dishwasher.

The related art dishwasher performs washing cycles based on the commands of a user and cannot control its washing cycles in accordance with the amount of food residue remaining on the used dishes or pollution level thereof. Accordingly, there are limitations in effectively washing the dishes.

SUMMARY OF THE INVENTION

Accordingly, the present invention is directed to a dishwasher and a method of controlling the same that substantially obviate one or more problems due to limitations and disadvantages of the related art.

An object of the present invention is to provide a dishwasher and a method for controlling the same determining a main washing cycle depending upon an amount of food residue on used dishes or a pollution level thereof.

Another object of the present invention is to provide a dishwasher and a method for controlling the same accurately detecting a pollution level of a washing water, even when a functions of a pollution level detector becomes defective.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a dishwasher includes supplying washing water to the dishwasher, detecting for an N number of times a pollution level of the supplied washing water during a preliminary washing cycle, and comparing the detected pollution levels with a reference pollution level, and carrying out a main washing cycle depending upon a comparison result between the detected pollution levels and the reference pollution level.

The method for controlling a dishwasher further includes detecting an initial pollution level of the supplied washing water prior to the preliminary washing cycle, and determining the initial pollution level of the supplied washing water as the reference pollution level. Also, the method further includes draining the supplied washing water out of the dishwasher, when the detected initial pollution level exceeds a predetermined pollution level range, and resupplying washing water to the dishwasher.

The comparing the detected pollution levels with a reference pollution level includes calculating an average value of the detected pollution levels, and calculating a difference value between the initial pollution level and the average value of the detected pollution levels. Also, the calculating an average value of the detected pollution levels comprises excluding at least one of a highest pollution level and at least one of a lowest pollution level, when calculating the average value of the detected pollution levels.

Also, depending upon a comparison result between the detected pollution levels and the reference pollution level, either one of a plurality of predetermined courses of the main washing cycle is selected, or at least one of a plurality of parameters of the main washing cycle is controlled. The parameters of the main washing cycle includes an amount of washing water, a washing time, a temperature of washing water, a number of turns for heating washing water, a level of washing water jet, and an amount of detergent corresponding to each of the predetermined courses of the main washing cycle is different from one another.

In another aspect of the present invention, a dishwasher includes a sensor detecting a plurality of pollution levels of washing water in the dishwasher during a preliminary washing cycle, and a controller comparing the detected pollution levels with a reference pollution level, and carrying out a main washing cycle depending upon a comparison result between each of the detected pollution levels and the reference pollution level.

Herein, the sensor is formed of a photo coupler sensing a light transmissivity of the washing water. And, depending upon a comparison result between the detected pollution levels and the reference pollution level, either the controller selects one of a plurality of predetermined courses of the main washing cycle, or the controller controls at least one of a plurality of parameters of the main washing cycle.

The dishwasher according to the present invention further includes a display notifying a user of a problem in the sensor, when the pollution level detected from the washing water is not within the predetermined pollution level range.

In another aspect of the present invention, a method for controlling a dishwasher includes supplying washing water to the dishwasher, and detecting a first turbidity level of the supplied washing water prior to a preliminary washing cycle, detecting a second turbidity level of the supplied washing water for at least one (1) time during the preliminary washing cycle, and carrying out a main washing cycle depending upon the first and second turbidity levels and a reference turbidity level.

The carrying out a main washing cycle depending upon the first and second turbidity levels and a reference turbidity level includes dividing the reference turbidity level by the first turbidity level, and multiplying the divided value by the second turbidity level, and carrying out the main washing cycle depending upon a calculated difference value between the reference turbidity level and the multiplied value. Also, depending upon a difference value between the reference turbidity level and the multiplied value, either one of a plurality of predetermined courses of the main washing cycle is selected, or at least one of a plurality of parameters of the main washing cycle is controlled.

In a further aspect of the present invention, a dishwasher includes a sensor detecting a first turbidity level of washing water in the dishwasher prior to a preliminary washing cycle, and detecting a second turbidity level of the washing water in the dishwasher during the preliminary washing cycle, and a controller carrying out a main washing cycle depending upon the first and second turbidity levels and a reference turbidity level.

The controller divides the reference turbidity level by the first turbidity level, and multiplies the divided value by the second turbidity level. Also, depending upon a difference value between the reference turbidity level and the multiplied value, either the controller selects one of a plurality of predetermined courses of the main washing cycle, or the controller controls at least one of a plurality of parameters of the main washing cycle.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
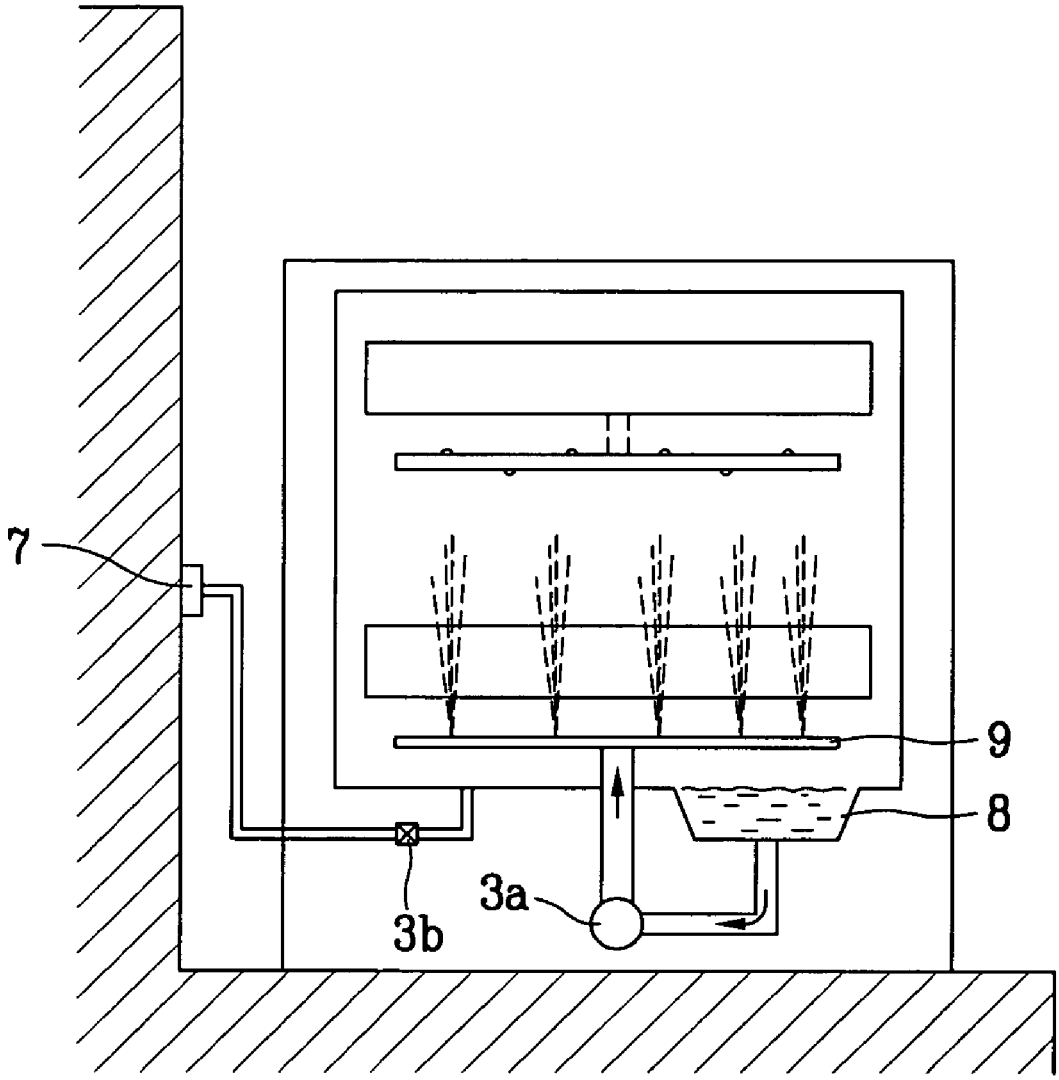
FIG. 1 illustrates a cross-sectional view of a general dishwasher.
Figure 2:
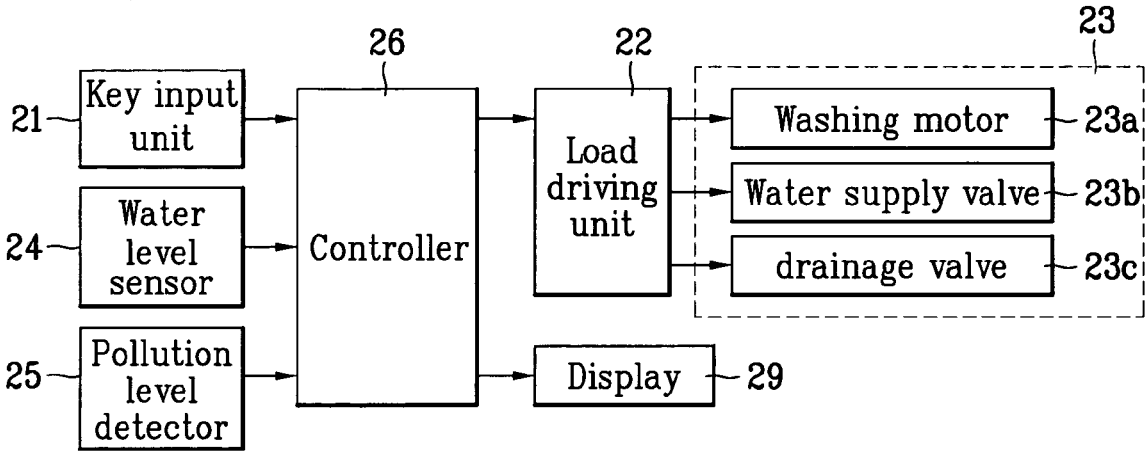
FIG. 2 illustrates a block diagram showing a structure of a dishwasher according to the present invention.

FIG. 2 illustrates a block diagram showing a structure of a dishwasher according to the present invention.

The dishwasher according to the present invention includes a key input unit 21 for inputting a user command, a water level sensor 24 sensing a water level within the dishwasher, a pollution level detector 25 detecting a pollution level of a washing water circulating within the dishwasher, a load driving unit 22 driving a washing motor 23*a*, a water supply valve 23*b*, and a drainage valve 23*c*, a display 29 indicating operations and misoperations of the dishwasher, and a controller 26 controlling each operation units of the dishwasher.

Figure 3:
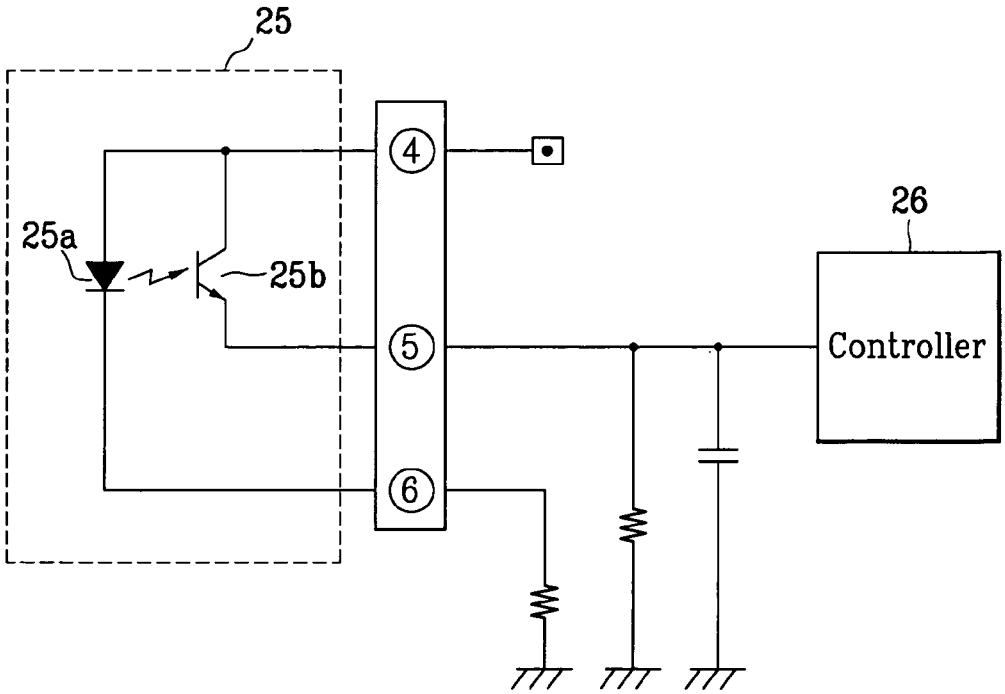
FIG. 3 illustrates a schematic view of a pollution level detector.

The pollution level detector 25 either detects the pollution level of the washing water held in the water tank or detects the pollution level of the washing water within a circulation tube between the water tank and the washing water jet. FIG. 3 illustrates an example of the pollution level detector according to the present invention. Referring to FIG. 3, a photo coupler as the pollution level detector 25. A light ray emitted from a light-emitting part 25*a* of the photo coupler passes through the washing water to be transmitted to a light-receiving part 25*b*. Then, the light-receiving part 25*b* supplies a signal corresponding to the received light ray to the controller 26. The controller 26 determined a turbidity level of the washing water based on the signal supplied by the light-receiving part 25*b*. In other words, the controller 26 determined the turbidity level of the washing water based on a voltage level of the received signal. When the turbidity level of the washing water is low, the level of the voltage transmitted to the controller 26 is high. Conversely, when the turbidity level of the washing water is high, the level of the voltage transmitted to the controller 26 is low. Accordingly, the turbidity level of the washing water can be determined depending upon the voltage level of the received signal.

The method of controlling the washing cycles of the dishwasher will now be described in detail.

First Embodiment

Figure 4:
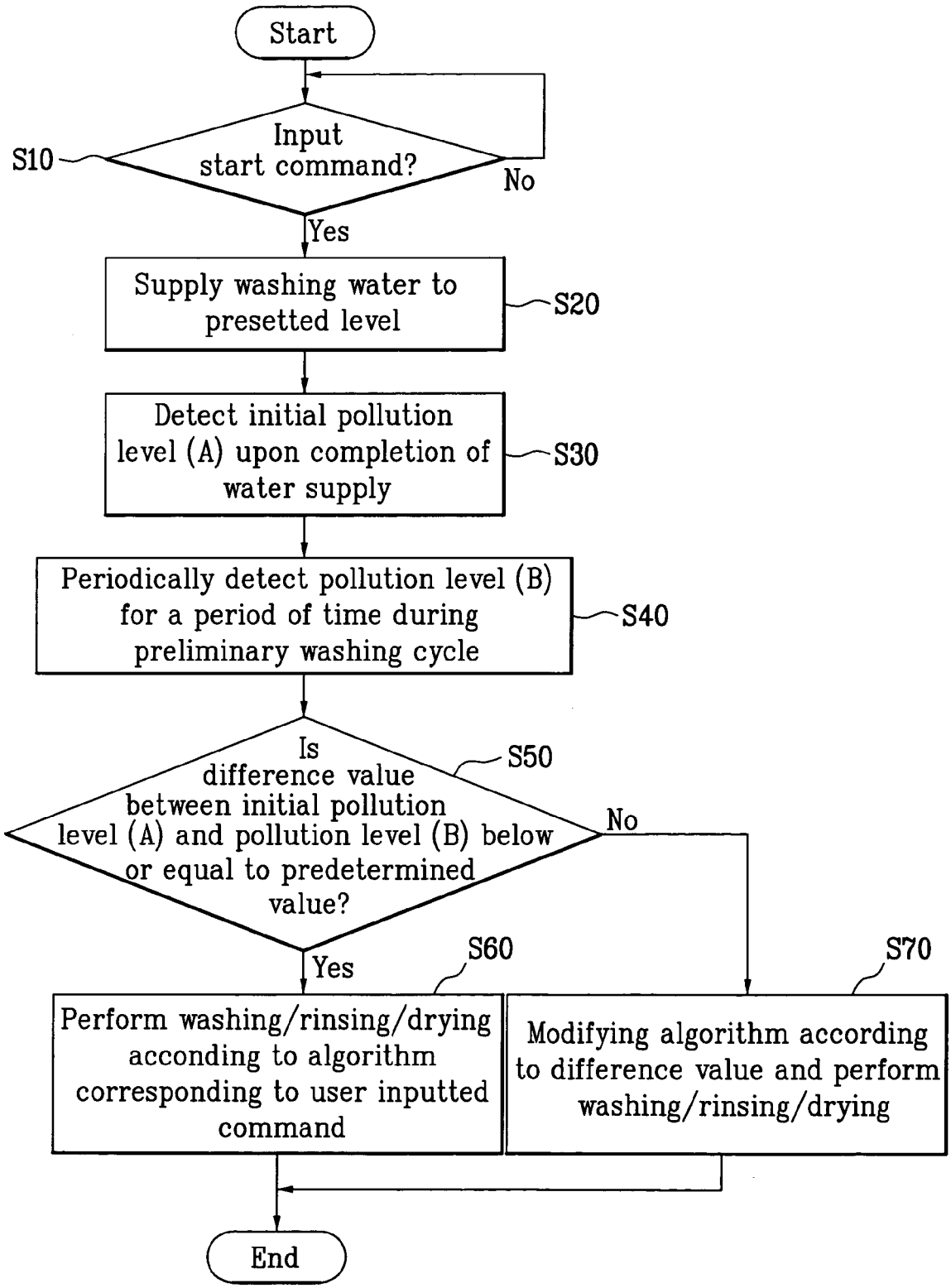
FIG. 4 illustrates a flowchart showing the process steps of controlling the dishwasher according to a first embodiment of the present invention.

FIG. 4 illustrates a flowchart showing the process steps of controlling the dishwasher according to a first embodiment of the present invention.

Referring to FIG. 4, first, the user arranges used dishes into the dishwasher to wash the dishes, then, the user inputs a start command (S10). The user can either select washing courses corresponding to the amount of dishes to be washed, the size and shape of the dishes, or select washing options. The washing options include an amount of washing water, a washing time, a temperature of washing water, a number of turns for heating washing water, a level of washing water jet, an amount of detergent, and so on. When the user does not select the washing cycle or the washing option, the controller 26 automatically selects a standard washing cycle.

When the user inputs the start command, the controller controls the water supply valve in order to supply the washing water to the water tank up to a presetted level (S20). The washing water is supplied to a level corresponding to the selected washing cycle or to the water level selected by the user. In other words, the water is supplied to a level corresponding to the amount of dishes to be washed and the size and shape of the dishes. The water level sensor 24 senses the water level within the water tank while the washing water is being supplied, and then sends a signal corresponding to the water level to the controller 26.

When the washing water reaches the presetted water level within the water tank, the controller 26 closes the water supply valve 23*b* to cut off the water supply. When the water supplying step is completed, the controller 26 commands the pollution level detector 25 to detect an initial pollution level of the washing water within the dishwasher (S30). The pollution level detector 25 detects the initial pollution level of the washing water at least one time. Then, the controller 26 either determines the initial pollution level detected one time as a reference pollution level A, or determines an average value of the initial pollution levels detected for a plurality of times as the reference pollution level A. Optionally, when the detected initial pollution level exceeds a predetermined pollution level range, the current washing water is drained and the washing water is resupplied to the dishwasher. In other words, when the initially supplied washing water is polluted, the polluted washing water is discarded, and a clean washing water is newly supplied.

After determining the reference pollution level A, the controller 26 performs a preliminary washing cycle. Then, in order to determine the amount of food residue remaining on the used dishes or the pollution level of the dishes, the controller 26 commands the pollution level detector 25 to detect the pollution level B of the washing water for an N number of times (i.e., at least one time) during the preliminary washing cycle or at the point the preliminary washing cycle is completed (S40). For example, when the pollution level B of the washing water is detected only one time, the pollution level is detected at the point the preliminary washing cycle is completed. And, when the pollution level B of the washing water is detected for more than one time, the pollution level of the washing water is periodically detected during the preliminary washing cycle. If the detected water pollution level B exceeds the predetermined pollution level range, the controller 26 displays a message informing the user of a problem or malfunction in the pollution level detector 25.

The controller 26 compares the reference pollution level A with the pollution level B detected for an N number of times, and determined the main washing cycle depending upon the comparison result (S50). There are diverse methods of determining the main washing cycle based on the reference pollution level A and the pollution level B detected for an N number of times.

For example, when the pollution level B is detected only one time, the controller 26 calculates a difference value (i.e., A−B) between the reference pollution level A and the pollution level B detected one time. Subsequently, when the difference value A−B is smaller than the predetermined value, either the main washing cycle corresponding to the washing cycle is performed, or the washing option selected by the user or the main washing cycle corresponding to the standard washing cycle is performed (S60). Alternatively, when the difference value A−B is greater than the predetermined value, either the main washing cycle corresponding to the difference value A−B is performed, or the controller 26 adjusts at least one of the parameters in accordance with the difference value A−B so as to perform the main washing cycle corresponding to the adjusted parameters (S70). The parameters include amount of washing water, washing time, temperature of washing water, number of turns for heating washing water, level of washing water jet, amount of detergent, and so on. Since the pollution level of the washing water increases as the difference value A−B becomes larger, either the length of the washing cycle should be extended or the number of turns for heating the washing water should be increased.

When the pollution level B is detected at least two times, the controller 26 calculates an average value B' of the pollution levels detected at least two times. More specifically, the controller 26 calculates an average value of the detected pollution levels B excluding at least one of a highest pollution level and at least one of a lowest pollution level. Then, the controller 26 calculates a difference value (i.e., A−B') between the reference pollution level A and the calculated average value B'. Subsequently, when the difference value A−B', between the reference pollution level A and the calculated average value B', is smaller than the predetermined value, either the main washing cycle corresponding to the washing cycle is performed, or the washing option selected by the user or the main washing cycle corresponding to the standard washing cycle is performed (S60). Alternatively, when the difference value A−B' is greater than the predetermined value, either the main washing cycle corresponding to the difference value A−B' is performed, or the controller 26 adjusts at least one of the parameters in accordance with the difference value A−B' so as to perform the main washing cycle corresponding to the adjusted parameters (S70). In addition, the controller 26 can also adjust the rinsing cycle and the drying cycle in accordance with the difference value A−B'.

When the pollution level B is detected at least two times, the controller 26 can also calculate difference values A−B between the reference pollution level A and each of the pollution levels B detected at least two times, and then calculate an average value of each of the calculated difference values A−B, thereby determining the main washing cycle accordingly.

Second Embodiment

Figure 5:
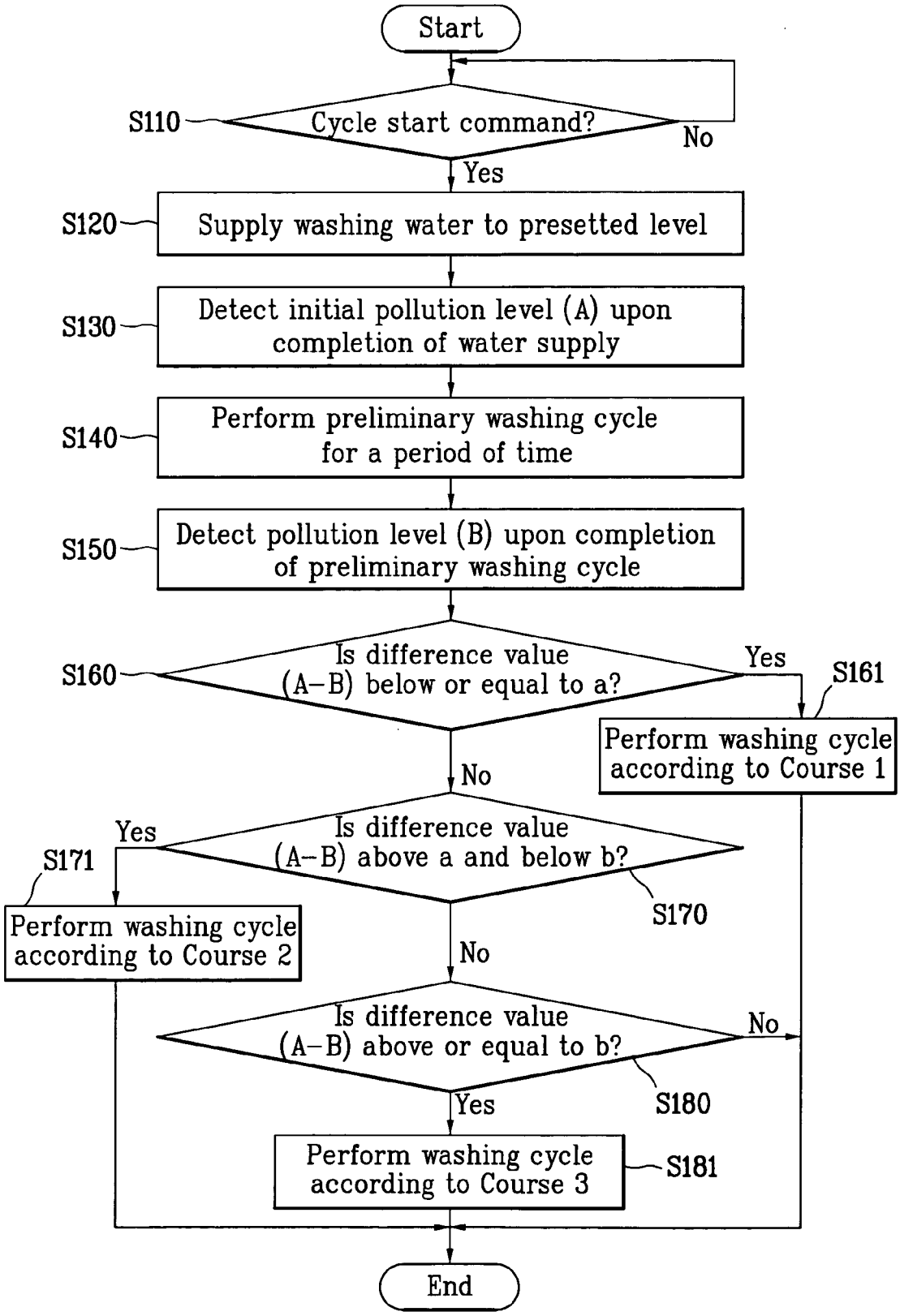
FIG. 5 illustrates a flowchart showing the process steps of controlling the dishwasher according to a second embodiment of the present invention.

FIG. 5 illustrates a flowchart showing the process steps of controlling the dishwasher according to a second embodiment of the present invention.

Referring to FIG. 5, first, the user arranges used dishes into the dishwasher to wash the dishes, then, the user inputs a start command (S110). The user can either select washing courses corresponding to the amount of dishes to be washed, the size and shape of the dishes, or select washing options. When the user does not select the washing cycle or the washing option, the controller 26 automatically selects a standard washing cycle.

When the user inputs the start command, the controller supplies the washing water to the water tank up to a presetted level (S120). The washing water is supplied to a level corresponding to the selected washing cycle or to the water level selected by the user.

When the water supplying step is completed, the controller 26 commands the pollution level detector 25 to detect an initial pollution level of the washing water within the dishwasher (S130). The pollution level detector 25 detects the initial pollution level of the washing water at least one time. Then, the controller 26 either determines the initial pollution level detected one time as a reference pollution level A, or determines an average value of the initial pollution levels detected for a plurality of times as the reference pollution level A. Optionally, when the detected initial pollution level exceeds a predetermined pollution level range, the current washing water is drained and the washing water is resupplied to the dishwasher.

After determining the reference pollution level A, the controller 26 performs a preliminary washing cycle (S140). Then, the controller 26 commands the pollution level detector 25 to detect the pollution level B of the washing water for an N number of times (i.e., at least one time) during the preliminary washing cycle or at the point the preliminary washing cycle is completed (S150). If the detected water pollution level B exceeds the predetermined pollution level range, the controller 26 displays a message informing the user of a problem or malfunction in the pollution level detector 25.

The controller 26 compares the reference pollution level A with the pollution level B detected for an N number of times, and determined the main washing cycle depending upon the comparison result. When the pollution level B is detected only one time, the controller 26 calculates a difference value (i.e., A−B) between the reference pollution level A and the pollution level B detected one time. Subsequently, the controller 26 sequentially compares the difference value A−B with the predetermined values a and b (S160, S170, and S180), then selects one of the washing cycles or selectively controls the washing parameters corresponding to the difference value A−B. Examples of washing cycles determined and set based on the difference value A−B are shown in Table 1 below.

TABLE 1

| Difference Value A − B | Condition of Cycle |
|---|---|
| A − B ≦ 0.5 V | Course 1 - Washing time: 10 min., Heating turns: 1 |
| 0.5 V < A − B < 1.8 V | Course 2 - Washing time: 15 min., Heating turns: 2 |
| A − B ≧ 1.8 V | Course 3 - Washing time: 20 min., Heating turns: 3 |

As shown in Table 1, the controller 26 compares the difference value A−B with the predetermined values 0.5V and 1.8V. If the difference value A−B is less than or equal to 0.5V, the controller 26 selects Course 1 (S161). When the difference value A−B is greater than 0.5V and less than 1.8V, the controller 26 selects Course 2 (S171). And, finally, if the difference value A−B is greater than or equal to 1.8V, the controller 26 selects Course 3 (S181). Then, the controller 26 performs the main washing cycle in accordance with the selected course.

When the pollution level B is detected at least two times, as described in the first embodiment of the present invention, the controller 26 calculates an average value B' of the pollution levels detected at least two times. Then, the controller 26 calculates a difference value (i.e., A−B') between the reference pollution level A and the calculated average value B'. Then, the controller 26 sequentially compares the difference value A−B' with the predetermined values (S160, S170, and S180), and then selects one of the washing cycles or selectively controls the washing parameters corresponding to the difference value A−B'.

When the pollution level B is detected at least two times, the controller 26 can also calculate difference values A−B between the reference pollution level A and each of the pollution levels B detected at least two times, and then calculate an average value of each of the calculated difference values A−B, thereby determining the main washing cycle accordingly.

Third Embodiment

Figure 6:
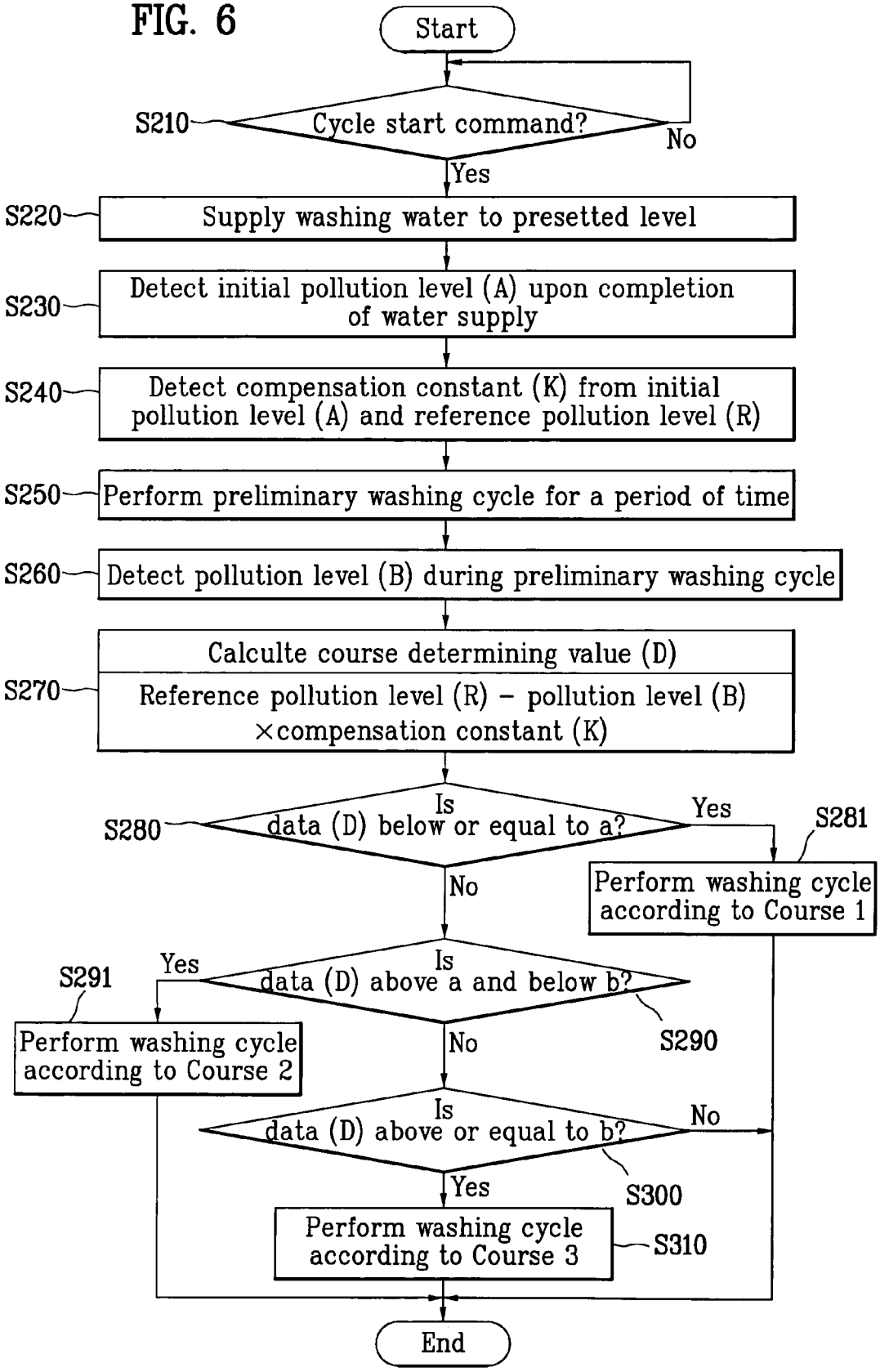
FIG. 6 illustrates a flowchart showing the process steps of controlling the dishwasher according to a third embodiment of the present invention.

FIG. 6 illustrates a flowchart showing the process steps of controlling the dishwasher according to a third embodiment of the present invention.

Referring to FIG. 6, the user arranges used dishes into the dishwasher to wash the dishes, then, the user inputs a start command (S210). The user can either select washing courses corresponding to the amount of dishes to be washed, the size and shape of the dishes, or select washing options. When the user does not select the washing cycle or the washing option, the controller 26 automatically selects a standard washing cycle.

When the user inputs the start command, the controller supplies the washing water to the water tank up to a presetted level (S220). The washing water is supplied to a level corresponding to the selected washing cycle or to the water level selected by the user.

When the water supplying step is completed, the controller 26 commands the pollution level detector 25 to detect an initial pollution level A of the washing water within the dishwasher (S230). The pollution level detector 25 detects the initial pollution level A of the washing water at least one time. When the initial pollution level is detected for a plurality of times, the controller 26 determines an average value of the detected initial pollution levels as the reference pollution level A. Optionally, when the detected initial pollution level exceeds a predetermined pollution level range, the current washing water is drained and the washing water is resupplied to the dishwasher.

The controller 26 calculates a compensation constant K based on the initial pollution level A and the reference pollution level R (S240). The reference pollution level R refers to the pollution level of a clean water detected from a normal pollution level detector 25, in other words, an ideal initial pollution level. The reference pollution level R is a predetermined value. The compensation constant K is used for compensating a common difference resulting from a malfunction or a problem in the performance of the pollution level detector 25. The compensation constant K is calculated by dividing the reference pollution level R by the initial pollution level A, as shown in Equation 1 below.

$$\text{compensation constant } (K) = \text{reference pollution level } (R) \div \text{initial pollution level } (A) \qquad \text{Equation 1}$$

The controller 26 performs a preliminary washing cycle for a set period of time (S250). The controller 26 commands the pollution level detector 25 to detect the pollution level B of the washing water for an N number of times (i.e., at least one time) during the preliminary washing cycle or at the point the preliminary washing cycle is completed (S260). If the detected water pollution level B exceeds the predetermined pollution level range, the controller 26 displays a message informing the user of a problem or malfunction in the pollution level detector 25.

The controller 26 controls a course determining data D based on the initial pollution level A, the pollution level B detected an N number of times, and the reference pollution level R (S270). When the pollution level B is detected for at least two times, an average value B' of the detected pollution levels is used. The course determining data D can be represented by Equation 2 below.

$$\text{course determining data } (D) = \text{reference pollution level } (R) - \text{detected pollution level } (B) \times \text{compensation constant } (K) \qquad \text{Equation 2}$$

When the course determining data D is calculated, the controller 26 sequentially compares the course determining data D with the predetermined values a and b (S280, S290, and S300), then selects one of the washing cycles or selectively controls the washing parameters corresponding to the course determining data D (S281, S291, and S310). For example, if the reference pollution level (R) is 5V, the detected pollution level (B) 4V, and the compensation constant (K) 3V, the course determining data (D) is equal to 1.25V. The controller 26 then compares the course determining data (D) value of 1.25V with the predetermined values a and b, and based on the comparison result, the controller 26 selects Course 2 of Table 1. Thereafter, the controller 26 performs the main washing cycle in accordance with the selected course.

As described above, in order to determine the amount of food residue remaining on the used dishes or the pollution level of the dishes, the pollution level of the washing water is detected during the preliminary washing cycle or at the point the preliminary washing cycle is completed. Then, the main washing cycle is decided based on the detected pollution level. Subsequently, since either the initial pollution level detected immediately after the water supply is completed and the pollution level detected during the preliminary washing cycle are used, or the compensation constant is used to compensate the common difference of the pollution level detector, the actual pollution level can be detected. Accordingly, the main washing cycle can be decided based on the accurate pollution level of the washing level, thereby enhancing the washing efficiency of the dishwasher.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a dishwasher, comprising:

supplying washing water to the dishwasher;

detecting an initial pollution level of the supplied washing water prior to a preliminary washing cycles;

determining the initial pollution level of the supplied washing water as a reference pollution level;

draining the supplied washing water out of the dishwasher, when the detected initial pollution level exceeds a predetermined pollution level range, and re-supplying washing water to the dishwasher;

detecting for an N number of times a pollution level of the supplied washing water during the preliminary washing cycle; and comparing the detected pollution levels with the reference pollution level, and carrying out a main washing cycle depending upon a comparison result between the detected pollution levels and the reference pollution level.

2. The method according to claim 1, wherein the pollution level of the supplied washing water is periodically detected during the preliminary washing cycle.

3. The method according to claim 1, wherein the comparing the detected pollution levels with a reference pollution level comprises:

calculating an average value of the detected pollution levels; and calculating a difference value between the initial pollution level and the average value of the detected pollution levels.

4. The method according to claim 3, wherein the calculating an average value of the detected pollution levels comprises excluding at least one of a highest pollution level and at least one of a lowest pollution level, when calculating the average value of the detected pollution levels.

5. The method according to claim 1, wherein the comparing a plurality of the detected pollution levels with a reference pollution level comprises:

calculating the difference values between the reference pollution level and each of the detected pollution levels; and calculating an average value of the difference values.

6. The method according to claim 1, wherein one of a plurality of predetermined courses of the main washing cycle is selected depending upon a comparison result between the detected pollution levels and the reference pollution level.

7. The method according to claim 6, wherein at least one of an amount of washing water, a washing time, a temperature of washing water, a number of turns for heating washing water, a level of washing water jet, and an amount of detergent corresponding to each of the predetermined courses of the main washing cycle is different from one another.

8. The method according to claim 1, wherein at least one of a plurality of parameters of the main washing cycle is controlled depending upon a comparison result between the detected pollution levels and the reference pollution level.

9. The method according to claim 8, wherein the parameters of the main washing cycle include an amount of washing water, a washing time, a temperature of washing water, a number of turns for heating washing water, a level of washing water jet, and an amount of detergent corresponding to each of the predetermined courses of the main washing cycle is different from one another.

10. The method according to claim 1, further comprising notifying a user of a problem in a pollution level sensor sensing the pollution level of the washing water, when the pollution level detected from the washing water is not within the predetermined pollution level range.

11. A method for controlling a dishwasher, comprising:

supplying washing water to the dishwasher, and detecting a first turbidity level of the supplied washing water prior to a preliminary washing cycle;

draining the supplied washing water out of the dishwasher, when the first turbidity level exceeds a predetermined turbidity level range, and re-supplying washing water to the dishwasher;

detecting a second turbidity level of the supplied washing water for at least one (1) time during the preliminary washing cycle; and carrying out a main washing cycle depending upon the first and second turbidity levels and a reference turbidity level.

12. The method according to claim 11, wherein the carrying out a main washing cycle depending upon the first and second turbidity levels and a reference turbidity level comprises:

calculating a course determining data (D) based on the first and second turbidity levels and a reference turbidity level; and carrying out the main washing cycle depending upon the course determining data.

13. The method according to claim 12, wherein one of a plurality of predetermined courses of the main washing cycle is selected depending upon the course determining data.

14. The method according to claim 13, wherein at least one of an amount of washing water, a washing time, a temperature of washing water, a number of turns for heating washing water, a level of washing water jet, and an amount of detergent corresponding to each of the predetermined courses of the main washing cycle is different from one another.

15. The method according to claim 12, wherein at least one of a plurality of parameters of the main washing cycle is controlled depending upon the course determining data.

16. The method according to claim 15, wherein the parameters of the main washing cycle include an amount of washing water, a washing time, a temperature of washing water, a number of turns for heating washing water, a level of washing water jet, and an amount of detergent corresponding to each of the predetermined courses of the main washing cycle is different from one another.

17. The method according to claim 12, wherein calculating the course determining data (D) based on the first and second turbidity levels and a reference turbidity level comprises:

calculating a compensation constant (K) by dividing the reference turbidity level by the first turbidity level;

multiplying the compensation constant (K) by the second turbidity level; and calculating the course determining data (D) by subtracting the multiplied value from the reference turbidity level.

18. A dishwasher, comprising:

a sensor configured to detect a first turbidity level of washing water in the dishwasher prior to a preliminary washing cycle, and detect a second turbidity level of the washing water in the dishwasher during the preliminary washing cycle; and a controller configured to drain the supplied washing water out of the dishwasher, when the first turbidity level exceeds a predetermined turbidity level range, re-supply washing water to the dishwasher, and carry out a main washing cycle depending upon a course determining data based on the first and second turbidity levels and a reference turbidity level.

19. The dishwasher according to claim 18, wherein the controller calculates a compensation constant (K) by dividing the reference turbidity level by the first turbidity level, multiplies the compensation constant by the second turbidity level, and calculates the course determining data by subtracting the multiplied value from the reference turbidity level.

20. The dishwasher according to claim 19, wherein the controller selects one of a plurality of predetermined courses of the main washing cycle depending upon the course determining data.

21. The dishwasher according to claim 19, wherein the controller controls at least one of a plurality of parameters of the main washing cycle depending upon the course determining data.

22. A method for controlling a dishwasher, comprising:

supplying washing water to the dishwasher, and detecting a first pollution level of the supplied washing water prior to the preliminary washing cycle;

draining the supplied washing water our of the dishwasher, when the first pollution level exceeds a predetermined pollution level range, and re-supplying washing water to the dishwasher;

detecting a second pollution level of the supplied washing water for at least one (1) time during the preliminary washing cycle; and carrying out a main washing cycle depending upon the first and second pollution levels and a reference pollution level.

23. The method according to claim 22, wherein the carrying out a main washing cycle depending upon the first and second pollution levels and a reference pollution level comprises:

calculating a course determining data (D) based on the first and second turbidity levels and a reference turbidity level; and carrying out the main washing cycle depending upon the course determining data.

24. The method according to claim 23, wherein one of a plurality of predetermined courses of the main washing cycle is selected depending upon the course determining data.

25. The method according to claim 24, wherein at least one of an amount of washing water, a washing time, a temperature of washing water, a number of turns for heating washing water, a level of washing water jet, and an amount of detergent corresponding to each of the predetermined courses of the main washing cycle is different from one another.

26. The method according to claim 23, wherein at least one of a plurality of parameters of the main washing cycle is controlled depending upon the course determining data.

27. The method according to claim 26, wherein the parameters of the main washing cycle include an amount of washing water, a washing time, a temperature of the washing water, a number of turns for heating washing water, a level of washing water jet, and an amount of detergent corresponding to each of the predetermined courses of the main washing cycle is different from one another.

28. The method according to claim 23, wherein calculating the course determining data (D) based on the first and second turbidity levels and a reference turbidity level comprises:

calculating a compensation constant (K) by dividing the reference turbidity level by the first turbidity level;

multiplying the compensation constant (K) by the second turbidity level; and calculating the course determining data (D) by subtracting the multiplied value from the reference turbidity level.

29. A dishwasher, comprising:

a sensor configured to detect a first pollution level of washing water in the dishwasher prior to a preliminary washing cycle, and detect a second pollution level of the washing water in the dishwasher during the preliminary washing cycle; and a controller configured to drain the supplied washing water out of the dishwasher, when the first pollution level exceeds a predetermined pollution level range, re-supply washing water to the dishwasher, and carry out a main washing cycle depending upon a course determining data based on the first and second pollution levels and a reference pollution level.

30. The dishwasher according to claim 29, wherein the controller calculates a compensation constant (K) by dividing the reference turbidity level by the first turbidity level, multiplies the compensation constant by the second turbidity level, and calculates the course determining data by subtracting the multiplied value from the reference turbidity level.

31. The dishwasher according to claim 30, wherein the controller selects one of a plurality of predetermined courses of the main washing cycle depending upon the course determining data.

32. The dishwasher according to claim 30, wherein the controller controls at least one of a plurality of parameters of the main washing cycle depending upon the course determining data.

* * * * *